US008038042B2

(12) United States Patent
Bartel

(10) Patent No.: US 8,038,042 B2
(45) Date of Patent: Oct. 18, 2011

(54) BACKPACK

(75) Inventor: Kaja Inga Anita Bartel, Nuremberg (DE)

(73) Assignee: adidas International Marketing BV, Amsterdam (NL)

( * ) Notice: Subject to any disclaimer, the term of this patent is extended or adjusted under 35 U.S.C. 154(b) by 132 days.

(21) Appl. No.: 11/933,961

(22) Filed: Nov. 1, 2007

(65) Prior Publication Data

US 2008/0149676 A1 Jun. 26, 2008

(30) Foreign Application Priority Data

Nov. 2, 2006 (DE) ..... 10 2006 051 765

(51) Int. Cl.
*A45F 3/08* (2006.01)

(52) U.S. Cl. ..... 224/634; 224/628; 224/633; 224/645; 224/153; 224/155

(58) Field of Classification Search ..... 224/153, 224/155, 628, 629, 630, 631, 633, 634, 635, 224/652, 653; 220/213, 252, 9.3; 248/95, 248/97, 98, 99; 297/188.02, 188.09, 188.1; 383/33, 34, 34.1
See application file for complete search history.

(56) References Cited

U.S. PATENT DOCUMENTS 2,099,924 A * 11/1937 Bressler ..... 150/123
2,558,995 A * 7/1951 Tullis ..... 190/8
3,669,489 A * 6/1972 Rock ..... 297/129
3,902,640 A 9/1975 Geiben
4,003,455 A * 1/1977 Cortese ..... 190/8
4,085,873 A 4/1978 Schweitzer
4,258,891 A * 3/1981 Mitchell et al. ..... 248/98
4,773,574 A 9/1988 Burgard
5,024,344 A * 6/1991 Paula ..... 220/9.3
5,497,919 A * 3/1996 Klinger ..... 224/416
5,626,271 A * 5/1997 Messey et al. ..... 224/161
5,667,066 A * 9/1997 Simpson ..... 206/278
5,762,243 A 6/1998 McMaster et al.
5,911,348 A 6/1999 Shook
5,927,798 A * 7/1999 Ahn ..... 297/129
5,944,241 A * 8/1999 Globig et al. ..... 224/577
5,988,476 A 11/1999 Olerio
6,000,752 A * 12/1999 Shyr ..... 297/188.08
6,029,877 A 2/2000 Woods
6,053,382 A 4/2000 Wyant
6,158,641 A 12/2000 Eyman et al.
6,375,258 B1 * 4/2002 Fang ..... 297/188.08
D460,614 S 7/2002 Reimers et al.
D461,048 S 8/2002 Blanking
6,446,851 B1 9/2002 Parks et al.
6,629,629 B2 10/2003 Lee et al.

(Continued)

FOREIGN PATENT DOCUMENTS

DE 28 25 366 12/1979

(Continued)

*Primary Examiner* — Justin Larson
*Assistant Examiner* — Steven M Landolfi, Jr.
(74) *Attorney, Agent, or Firm* — Sterne, Kessler, Goldstein & Fox P.L.L.C.

(57) ABSTRACT

A backpack which includes a frame and a cover. The frame has a first frame element which is connected with a first portion of the cover and a second frame element which is connected to a second portion of the cover. The second frame element is pivotably arranged on the first frame element at a region lying between an upper region and a lower region of the first frame element.

24 Claims, 6 Drawing Sheets

U.S. PATENT DOCUMENTS

| | | | | |
|---|---|---|---|---|
| 6,655,565 | B2 | 12/2003 | Godshaw et al. | |
| 6,685,072 | B2 | 2/2004 | Ho | |
| 6,824,209 | B1 * | 11/2004 | Redzisz et al. | 297/45 |
| 6,938,761 | B2 | 9/2005 | Nish | |
| 2003/0070703 | A1 * | 4/2003 | Zheng | 135/126 |
| 2005/0017041 | A1 | 1/2005 | Roberts | |
| 2005/0061844 | A1 | 3/2005 | Haro | |
| 2005/0098598 | A1 | 5/2005 | Kuhn | |

FOREIGN PATENT DOCUMENTS

| | | |
|---|---|---|
| DE | 295 02 045.8 | 5/1995 |
| JP | 2000-152819 | 6/2000 |
| WO | WO 03/099061 | 12/2003 |

* cited by examiner

BACKPACK

BACKGROUND OF THE INVENTION

1. Field of the Invention

The invention concerns a backpack.

2. Background Art

Backpacks are convenient means for the transport of items and are used more and more in daily life. Due to their flexible cover material, backpacks have a low weight and only minimally impede movement of the wearer. Moreover, backpacks can adjust their volume to the transported items due to the flexible material, so that in general an empty backpack occupies less volume than a full backpack.

The flexible material of a backpack, however, also limits its range of applications. Therefore, big backpacks for carrying heavy loads frequently have covers that are provided with a frame to achieve a better distribution of the load on the shoulder and the back. In some constructions, rigid parts of the backpack make sure that the backpack does not directly contact the back of the wearer, in order to promote ventilation of the back and reduce sweating. However, a backpack that includes a frame typically has a higher weight.

A further disadvantage of the flexible cover material of a backpack is that its contents are less protected than in a container made from a rigid material. The flexible material also leads to problems during packing of a backpack, in particular with big and heavy items, since the opening of a backpack is not rigid. For instance, putting a folder into the backpack usually requires a particular handling in order to create an appropriate shape of the opening of the backpack. These problems also arise whenever an item has to be gripped with two hands during packing. In this case, the help of a second person is frequently needed to hold the backpack open.

In order to overcome these disadvantages, U.S. Pat. No. 6,938,761 and U.S. Pat. No. 6,629,629 describe backpacks that have a hard shell made from substantially rigid material. A rigid backpack is, however, inconvenient to carry on the back and has a higher weight than a backpack made of flexible material. In addition, the described backpacks are assembled from several elements, which render their manufacture, handling, and storage more complicated.

Furthermore, U.S. Patent Publication No. 2005/0061844 and U.S. Pat. No. 5,911,348 describe backpacks which consist of a hard shell and a lid which are connected at the bottom side of the backpack. This leads to a large opening, which also does not have to be kept open with the hands. However, the backpack has to be laid down for packing, otherwise its content may drop out.

Given the foregoing, what is needed is a backpack which provides in particular protection of its contents and which can be easily packed.

BRIEF SUMMARY OF THE INVENTION

A backpack with a frame and a cover is presented. The frame is made of a substantially rigid material and includes a first frame element connected to a first portion of the cover and a second frame element connected to a second portion of the cover. The second frame element is pivotably connected to the first frame element at a region between an upper region and a lower region of the first frame element.

In one embodiment, the frame is rigid and the cover is flexible, such that the backpack provides protection of its contents and has a lower weight than backpacks which provide such protection by a rigid shell. The pivotable arrangement of a second frame element enables an opening to be formed in the flexible cover of the backpack through which the backpack can be packed or unpacked. In particular, the connection of the second frame element to the first frame element at a region between the upper and the lower region of the first frame element results in an opening which, on the one hand, is sufficiently large so that the backpack can be packed or unpacked conveniently, and on the other hand, does not span the whole length of the first frame element so that items do not simply drop out when the bag is in an open state.

In one embodiment, the second frame element is releasably connected to the first portion of the cover by, for example a zip, hook and loop fastener, or push buttons. In this way the backpack obtains a lockable opening through which the backpack may be packed or unpacked.

In one embodiment, a pocket is arranged at the second frame element, preferably in an upper region of the second frame element, so that a part of the second frame element forms a boundary for the pocket. This pocket is protected by the frame, and due to its arrangement at the opening of the backpack it can be easily accessed.

In one embodiment, one or more straps of the backpack, for example, a waist strap, has a tunnel or an opening for receiving cables, such as cables for earphones of a music player. This provides a comfortable storage for the earphones where they are always available.

In one embodiment, the side of the backpack directed towards the back of the wearer is adjusted to the form of a spine. This provides a high comfort when wearing the backpack since the load is distributed evenly on the back of the wearer.

Furthermore, the second frame element and the first frame element may be provided with a locking mechanism to lock movement of the second frame element in at least two positions. Therefore, the opening which is formed in the backpack by pivoting the second frame element is stable. No hand is needed to keep the opening open, and the backpack can be packed or unpacked more easily. Locking in more than two positions enables the opening of the backpack to adjust to different sizes.

The frame may also include a third frame element, wherein a lower region of the third frame element and the lower region of the first frame element define a base for the backpack. Such a base facilitates standing the backpack in an upright position even when it is empty and also facilitates packing and unpacking of the backpack.

In one embodiment, the upper region of the first frame element and the upper region of the second frame element define a seat, with a third portion of the cover extending between the upper region of the first frame element and the upper region of the second frame element, being used as the seat. Therefore, the backpack according to this embodiment of the invention can not only be deposited in an upright position with a stable base, it can also be used as a seat. Due to the frame, it is possible to use the backpack as a seat even when the backpack is empty or only partially packed.

In one embodiment, the second frame element and the third frame element of the backpack are fixed in a common region of the first frame element, wherein the common region is preferably positioned in the middle between the upper and the lower region of the first frame element. In a closed state of the backpack the first frame element, the second frame element and the third frame element may form the shape of an X in cross-sectional view. By this X-shape, the frame obtains a particularly simple and stable form and simultaneously defines a volume as large as possible for the interior of the backpack. Inside this volume items are additionally protected by the rigid frame.

In one embodiment, a handle may be integrally formed with the frame, which may be formed in the upper region of the first frame element. This avoids the need for fixation of a separate handle to the backpack.

In a further embodiment, the cover of the backpack is concertina-folded in one or more portions. This folding supports opening and closing of the backpack by facilitating folding and unfolding of the corresponding portions of the cover.

Further embodiments, features, and advantages of the backpack presented herein are described in detail below with reference to the accompanying drawings.

BRIEF DESCRIPTION OF THE FIGURES

The accompanying drawings, which are incorporated herein and form part of the specification, describe aspects of the present invention. Together with the detailed description, the drawings further serve to explain the principles of and to enable a person skilled in the relevant art(s) to make and use the methods and systems presented herein. In the drawings, like reference numbers indicate identical or functionally similar elements.

FIG. 11(*b*) is a side view the backpack of FIG. 11(*a*).

DETAILED DESCRIPTION OF THE INVENTION

In the following detailed description, embodiments of the present invention are presented with reference to an exemplary backpack. However, it is to be understood that the present invention is not limited to backpacks but can be applied to any type of container for the transport of items such as bags, suitcases, schoolbags etc.

Figure 1:
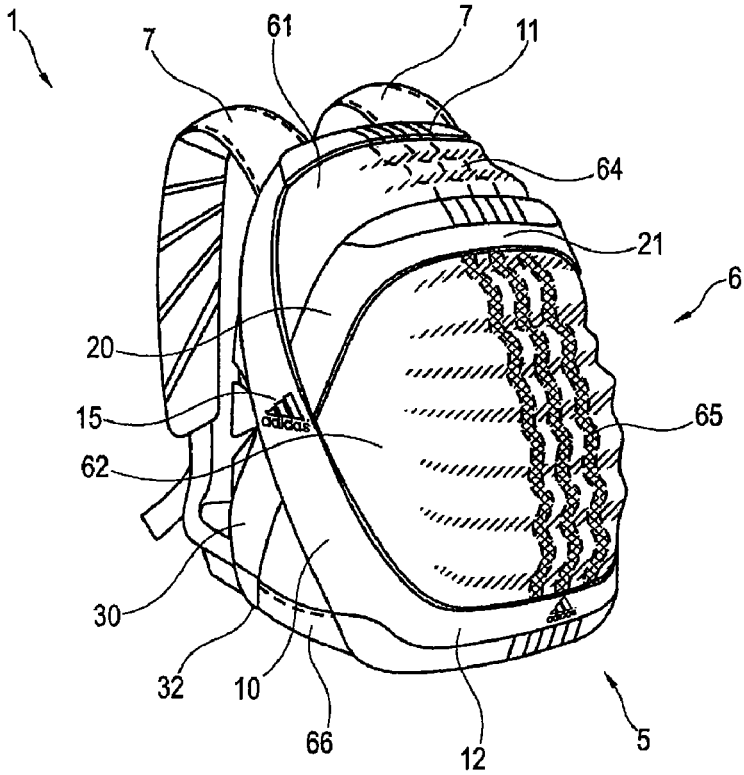
FIG. 1 is a perspective view of a backpack according to an embodiment of the present invention, showing the backpack in a closed state.
Figure 2:
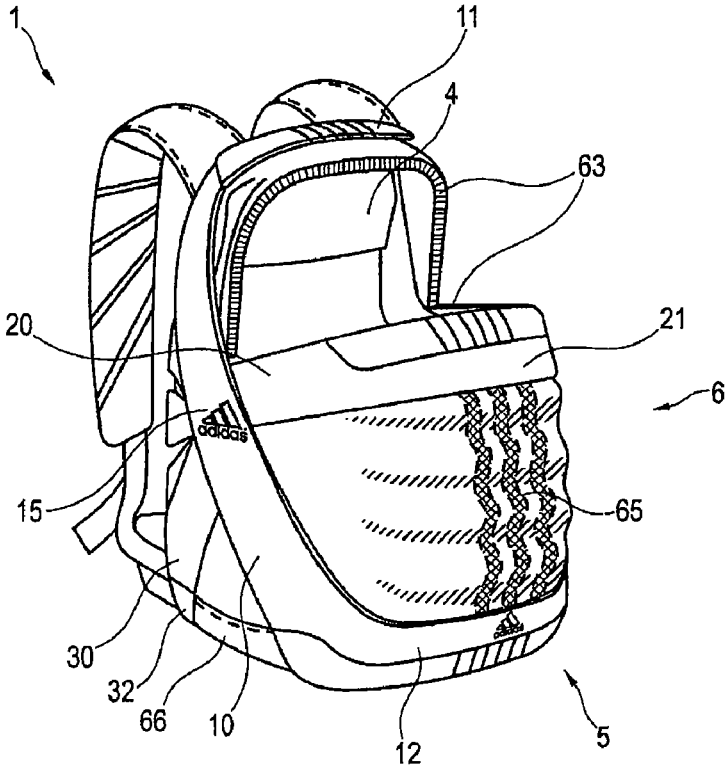
FIG. 2 is a perspective view of the backpack of FIG. 1 in an open state.
Figure 3:
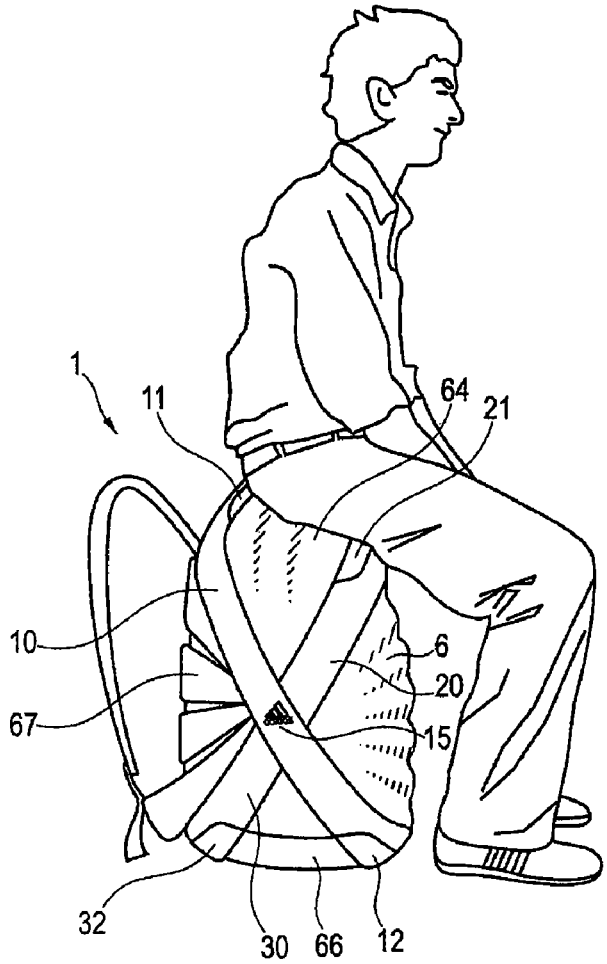
FIG. 3 is a side view of the backpack of the FIGS. 1 and 2, showing the backpack being used as a seat.

FIGS. 1-3 illustrate a backpack 1 according to an embodiment of the present invention. Backpack 1 includes a frame 5, a cover 6 and may further include a pair of straps 7. In one embodiment, the straps 7 are detachable. The cover 6 of the backpack 1 may be arranged on the inside the frame 5. Alternatively, the cover 6 may be arranged on the outside the frame 5. Furthermore, the cover 6 can also be arranged partially on the inside and partially on the outside the frame 5. The cover 6 is preferably manufactured from a flexible material, preferably from a waterproof material, such as a plastic fabric, e.g. Cordura®. Parts of the cover 6 can also be manufactured or enforced with a rigid or a bendable hard material, for example on a bottom side 66 of the backpack 1 or in the region of the back of the wearer of the backpack 1.

The frame 5 is made of a substantially rigid material and includes a first frame element 10 and a second frame element 20. The first frame element 10 is connected to a first portion 61 of the cover 6 and the second frame element 20 is connected to a second portion 62 of the cover 6. In one embodiment, the first frame element 10 is also connected to the second portion 62 of the cover 6.

FIG. 1 is a perspective view of the backpack 1 in a closed state, and FIG. 2 is a perspective view of the backpack 1 in an open state. As shown, the second frame element 20 is pivotably connected to the first frame element 10. As shown in FIG. 2, the second frame element 20 is pivoted away from an upper region 11 of the first frame element to generate an opening 4 which enables convenient packing and unpacking of the backpack 1. In one embodiment, the second frame element 20 is joined to the first frame element 10 in a region 15 between the upper region 11 and a lower region 12 of the first frame element 10. The region 15 may or may not be positioned exactly in the middle of the first frame element 10. Rather, region 15 may be positioned as needed to obtain the desired size of an opening 4 of the backpack 1.

In particular, the size of the opening 4 is determined by the position of region 15 at which the second frame element is pivotably connected to the first frame element 10. The lower the position of region 15, the larger is the opening 4 resulting from pivoting the second frame element 20. The higher the position of the region 15, the smaller is the opening 4 of the backpack 1, which reduces the risk that items may drop out during opening.

In one embodiment, the second frame element 20 can lock in two or more positions, thereby permitting the backpack 1 to remain in an open position without further effort. A maintained open position enables both hands to be used during packing and unpacking of the backpack 1. The ability to lock the second frame element 20 in more than two positions enables the opening of the backpack to be adjusted to different sizes.

In one embodiment, the second frame element 20 is releasably connected with the first portion 61 of the cover 6 by a closure 63. The closure 63 may be a zip fastener, as shown, or alternatively or in addition, other closures may be used, such as push buttons or hook and loop fasteners. Closure 63 may be arranged at the cover 6 directly along the edge of any one of the regions 11, 21 or 12 of the frame elements or between these regions. In the embodiment shown in FIG. 2, closure 63 is arranged at the cover 6 directly along the edge of the upper regions of the second frame element 20.

In FIG. 2, the opening 4 of the backpack 1 is arranged between the upper region 11 of the first frame element 10 and an upper region 21 of the second frame element 20, which facilitates in particularly packing of the backpack 1 from the top. In addition, regions 64 and 65 of the cover 6 adjacent to the pivotable second frame element 20 may be concertina-folded. This folding facilitates opening and closing of the backpack 1.

In another embodiment (not shown), an opening of the backpack 1 can be arranged between a lower region 12 of the first frame element 10 and the upper region 21 of the second frame element 20, which facilitates packing from the front of the backpack 1. For example, a closure may releasably connect the second frame element 20 to the second portion 62 of the cover 6, whereby detachment of the second portion 62 generates an opening for packing and unpacking of the backpack 1.

In another embodiment (not shown), the backpack 1 may have both an upper opening and a lower opening, respectively above and below the upper region 21 of the second frame element 20. In this embodiment, pivoting the region 21 upwards toward the upper region 11 of the first frame element 10 opens the lower opening and pivoting the region 21 downwards toward the lower region 12 of the first frame element 10 opens the upper opening. For example, a first closure may releasably connect the second frame element 20 to the first portion 61 of the cover 6, whereby detachment of the first portion 61 generates a first opening for packing and unpacking of the backpack 1 (similar to closure 63 and opening 4 shown in FIG. 2). Moreover, a second closure may releasably connect the second frame element 20 to the second portion 62 of the cover 6, whereby detachment of the second portion 62 generates a second opening for packing and unpacking of the backpack 1. This embodiment is particularly advantageous if the interior of the backpack is divided into two or more compartments since it allows access to each compartment.

In addition to the pivotable second frame element 20, the frame 5 may include further movable frame elements, with portions of cover 6 extending therebetween and detachable therefrom, so that more than one opening of the backpack 1 can be opened independently of each other.

In one embodiment, frame 5 includes a third frame element 30 which may be fixedly joined to the first frame element 10. A lower region 32 of the third frame element 30 and the lower region 12 of the first frame element 10 may define a base of the backpack 1, thereby allowing the backpack 1 to stand in an upright position, even when it is empty, and permitting convenient packing and unpacking. The third frame element 30 is connected to the first frame element 10 at region 15 where the second frame element 20 is pivotably connected to the first frame element 10. Alternatively, the second frame element 20 and the third frame element 30 may be connected to the first frame element 10 at different regions. It is particularly preferred that the first frame element 10, the second frame element 20 and the third frame element 30 are arranged in the shape of an X when the backpack 1 is closed and viewed in cross-section, or from the side, as shown in FIG. 3 (see also FIG. 7). Due to this X-shaped arrangement of the frame elements 10, 20 and 30, the frame 5 obtains a particularly simple and stable form and simultaneously defines a volume as large as possible for the interior of the backpack 1. In addition, items inside this volume, especially any fragile item such as a camera, are protected by the rigid frame 5.

In another embodiment (not shown), the second frame element 20 and the third element 30 are rigidly connected to each other so that the third element 30 moves away from the lower region 12 of the first frame element 10 so expand the base of the backpack 1 when the second frame element 20 is pivoted away from the upper region 11 of the first frame element 10 so as to open the backpack. In this instance, the frame 5 may be moved like scissors to open and close the backpack 1. In another embodiment, the second and the third frame element 20 and 30, respectively, are both pivotably connected to the first frame element. The third element 30 may then be pivoted toward the lower region 12 of the first frame element 10, whereby the frame 5 and therefore the back pack 1 may be made flat for storage purposes.

As shown in FIG. 3, the upper region 11 of the first frame element 10 and the upper region 21 of the second frame element 20 define a seat (shown at 64 in FIG. 1). In one embodiment, the seat is provided by the portion 64 of the cover 6 that extends between the upper region 11 of the first frame element 10 and the upper region 21 of the second frame element 20, when the backpack 1 is closed. The upper region 11 of the first frame element 10 may be higher than the upper region 21 of the second frame element 20, as shown.

The frame 5 may be reinforced in the regions 11, 12, 21, and 32 in order to protect it from damage, e.g. by rubber material. The frame 5 of the backpack 1 is preferably manufactured from plastic material, e.g. plastics reinforced with carbon fibers or full plastics. Every frame element can be manufactured from one or more separate elements, wherein single elements can be screwed, glued, riveted, clipped to each other etc. To increase the stability of the frame 5, portions or the whole frame can be provided with ribs. Further, the frame 5 can be manufactured from metal, preferably light metal. Also, plastic material, metal and/or wood can be combined with each other. Further, in one embodiment, in the regions 11 and 21, the frame 5 may be cushioned in order to facilitate a comfortable seat. The cover 6 may also be particularly protected in the region adjacent to the ground, for example by a dirt- and water-resistant coating.

Figure 4:
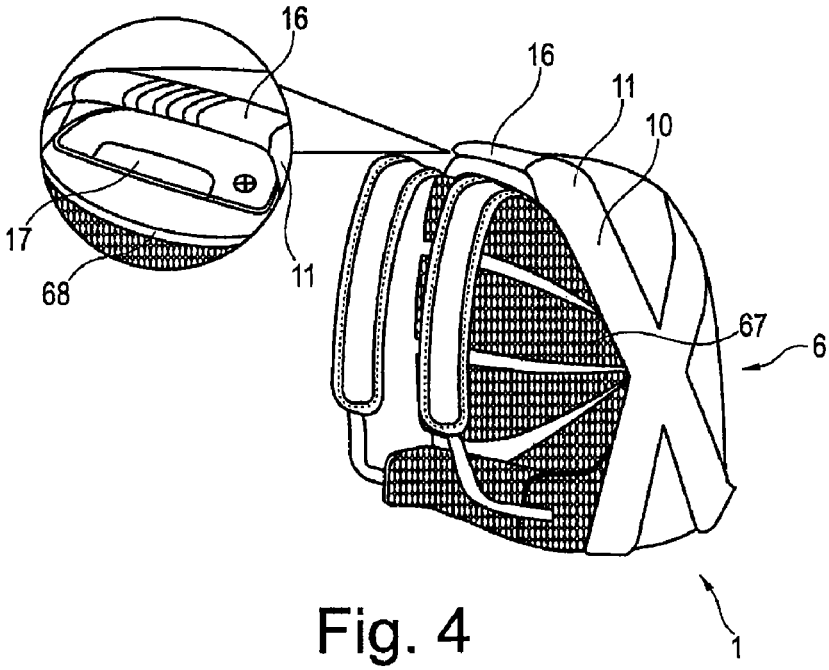
FIG. 4 is a perspective view of a backpack with a detailed illustration of an embodiment of an upper region of a first frame element according to another embodiment of the present invention.

FIG. 4 shows a perspective view of the backpack 1 provided with a cushioning 67 in the region of the back of the wearer, in accordance with one embodiment of the present invention. Also shown is a detailed view of a handle 16 provided on backpack 1. In particular, the upper region 11 of the first frame element 10 is integrally formed as a handle 16. In one embodiment, the handle 16 is formed as a recess in the upper region 11 of the first frame element 10. Alternatively or in addition, the cover 6 is fixed to the upper region 11 of the first frame element 10 in such a way that a distance is established between a region 68 of the cover 6 and the upper region 11 of the first frame element 10. An opening 17 may be located under the handle 16 for access to an interior compartment of backpack 1 or a separate small pocket may be located under the handle 16 for storage of valuables. For example, this small pocket can be used to store a portable music device such as an MP3 player. Furthermore, the cover 6 or the frame 5 may comprise an opening or tunnel (not shown) through which the cable for earphones can pass to be used by the wearer.

Figure 5:
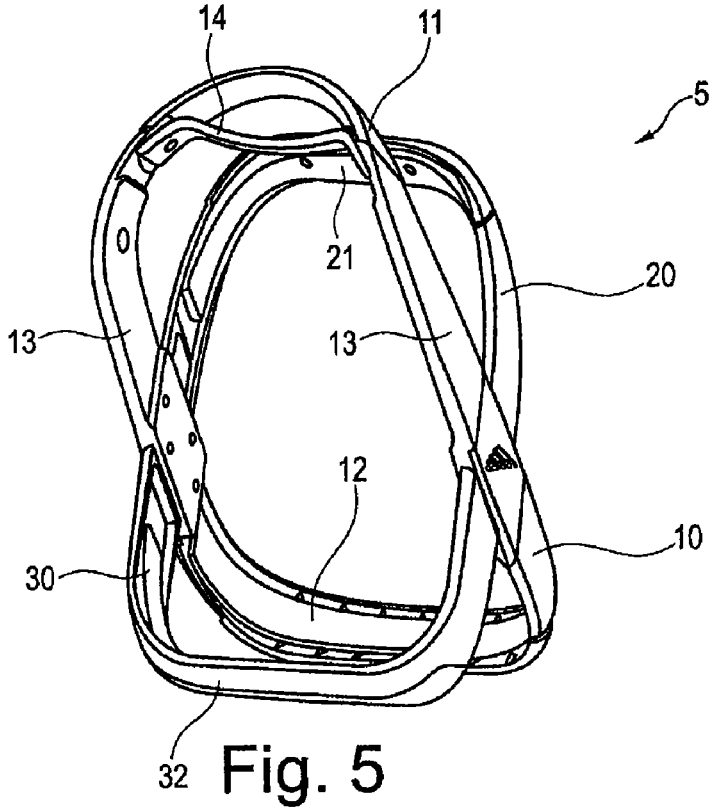
FIG. 5 is a perspective view of a frame of a backpack in accordance with one embodiment of the present invention.
Figure 6:
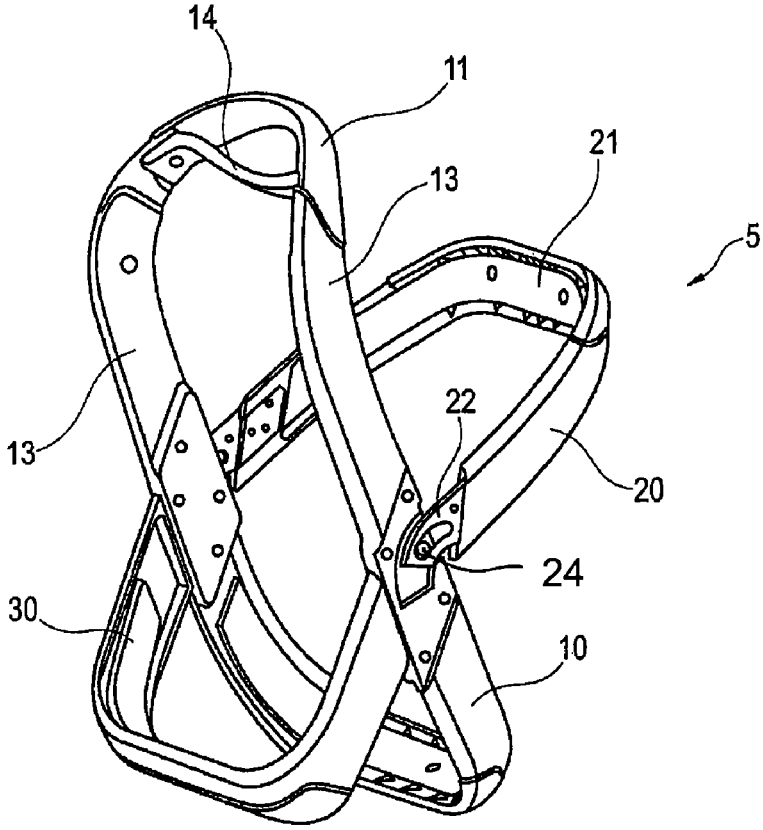
FIG. 6 is another perspective view of the frame of FIG. 5 with a pivoted second frame element.

FIGS. 5 and 6 show perspective views the frame 5 of the backpack 1 in accordance with an embodiment of the present invention. In the embodiment shown in FIG. 5, the upper region 11 and the side regions 13 of the first frame element 10 are substantially U-shaped. Similarly, the lower region 12 and the side regions 13 of the first frame element 10 are substantially U-shaped in a front view. Furthermore, in this embodiment, the second frame element 20 and the third frame element 30 are substantially U-shaped. The upper region 11 of the first frame element 10 is preferably substantially curved, for example to form the handle 16 shown in FIG. 4 or a small boundary for the seat. The regions 12, 21, 32 are preferably substantially flat. In another embodiment (not shown), the upper region 21 of the second frame element 20 is similarly curved as the upper region 11 of the first frame element 10. The side regions 13 of the first frame element 10 run preferably substantially in parallel. However, they can also be inclined with respect to each other.

Further, a support 14 may be attached to the frame 5 so as to be adjacent the upper region 11 of the first frame element 10. The cover 6 (not shown in FIG. 5) can be connected to the support 14 so that a distance between the cover 6 and the upper region 11 of the first frame element 10 is established. The upper region 11 of the first frame element 10 may then be used as a handle, as described above in connection with FIG. 4. Support 14 may be made of a rigid material or a flexible material, e.g. a textile fabric.

FIG. 6 shows the second frame element 20 in a pivoted position. Each end of the second frame element 20 include an elongated hole 22 with which a corresponding pin 24 of the first frame element 10 engages. The length of the elongated hole 22 determines the range of pivoting of the second frame element 20. In a reverse arrangement (not shown), the elongated hole 22 is arranged at the first frame element 10 and the pin is arranged at the second frame element 20. In alternative embodiments (note shown), instead of elongated hole 22, pivoting of the second frame element 20 is enabled by an axis with a stop or by a hinge, similar to a door hinge, joining the second frame element 20 with the first frame element 10 along the axis of pin 24. In another embodiment, the first frame element 10 and the second frame element 20 may be connected by a flexible material.

FIG. 6 also shows that the upper region 11 of the first frame element 10 is not exactly located at the elongation of the side regions 13, but that it is curved towards the second frame element 20 (cf. also the side view from FIG. 3). This curvature permits the shape of the frame 5 to form to the back and the neck of the wearer of the backpack 1 and also forms a small boundary for the seat, as noted above.

In other embodiments (not shown), the frame 5 comprises one or more supports in order to support the stability of the frame 5. For example, a support may connect the two side regions 13 of the first frame element 10 to avoid a lateral deformation during sitting. However, the higher stability is achieved at the expense of an increased constructive effort and a higher weight of the frame 5.

Figure 7:
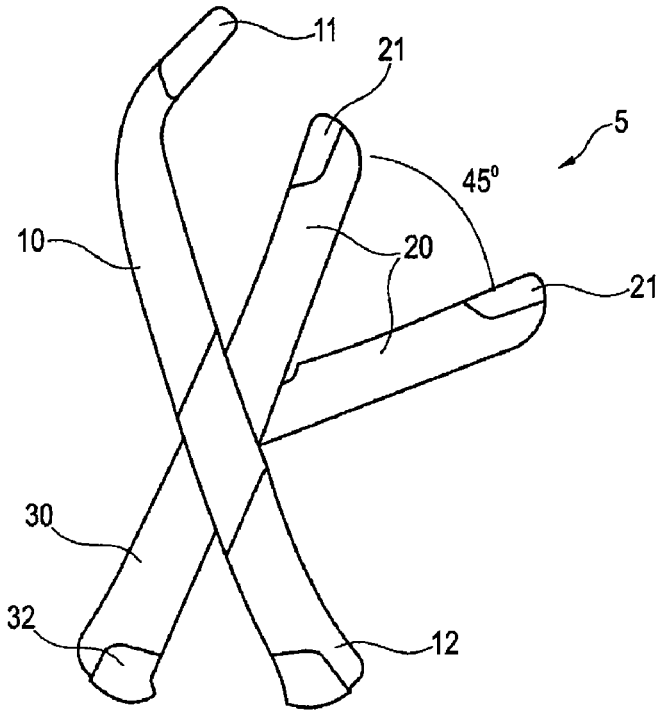
FIG. 7 is a side view of the frame of FIG. 5 illustrating pivoting of the second frame element.

FIG. 7 shows another side view of the frame 5 from FIG. 5, showing pivoting of the second frame element 20. In this embodiment, the second frame element 20 pivots by 45 degrees.

Figure 8:
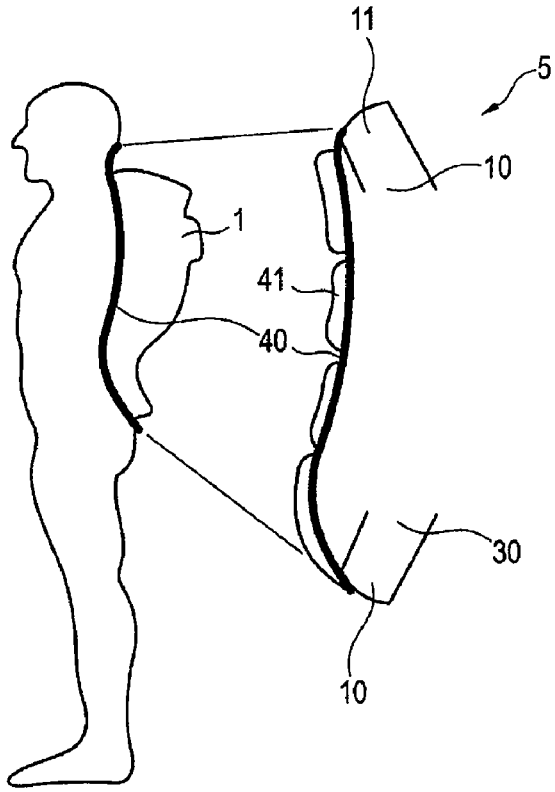
FIG. 8 is a side schematic view of a backpack with a detailed view of an ergonomically formed frame according to another embodiment of the present invention.

FIG. 8 shows a schematic of a rear part 40 of the backpack 1 in accordance with another embodiment of the present invention. In particular, rear part 40 faces the back of the wearer of the backpack and conforms to the wearer's spine. This provides the backpack with a particularly high wearing comfort, since the load is distributed evenly on the back of the wearer. To further improve distribution of the load, the backpack 1 can be provided with a waist strap (not shown). Preferably, the rear part 40 is fixed to the frame 5, and in one embodiment, the rear part 40 is fixed to frame 5 in the upper region 11 of the first frame element 10 and the lower region 32 of the third frame element 30. Furthermore, the rear part 40 may include one or more cushions 41, which are arranged and formed such that circulation of air between the back of the wearer and the rear part 40 is facilitated.

Figure 9:
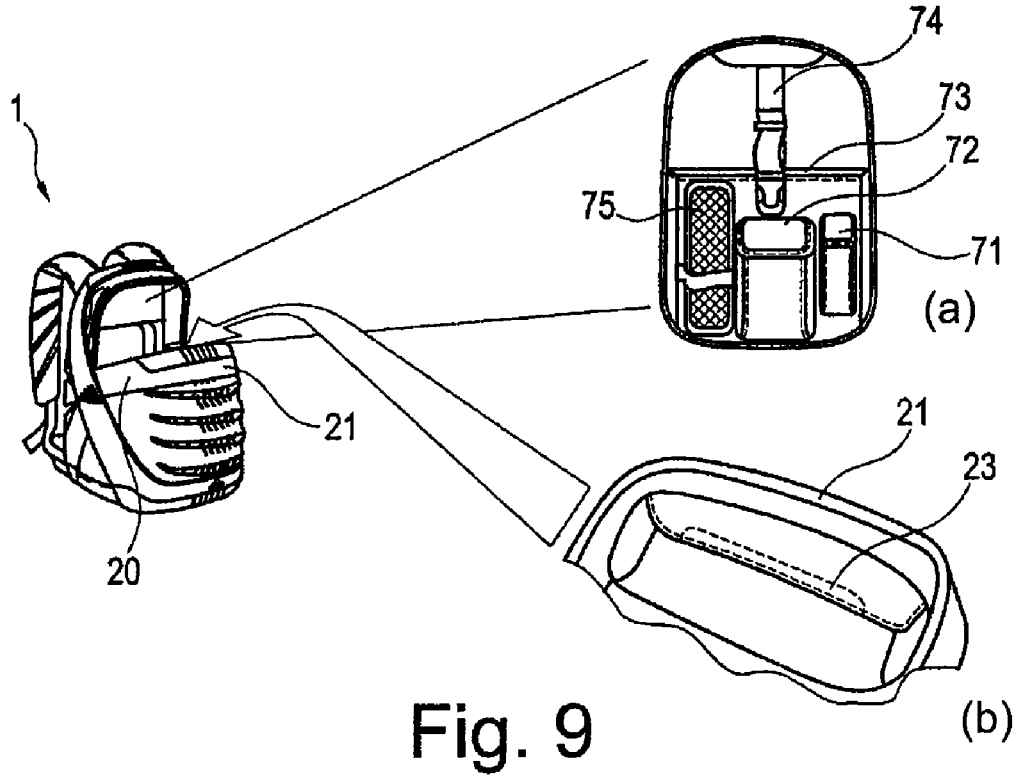
FIG. 9 is a perspective view of the backpack of FIG. 1 with a detailed view (a) of inside pockets and a detailed view (b) of a pocket at the frame of the backpack.

FIG. 9 shows an embodiment of the backpack 1 from FIG. 1 with detailed views (a) and (b) of inside compartments. The detailed view (a) shows a padded compartment 73 for a notebook computer which extends to the bottom of the backpack 1 and which is closed by a latch 74, a cable pocket 75, a pocket 72 and another pocket 71, which may be used to hold a mobile phone, for example. The detailed view (b) shows a pocket 23 disposed at an inner side of the second frame element 20. The pocket 23 is may be disposed at the upper region 21 of the second frame element 20, so that a part of the second frame element 20 forms a boundary for the pocket 23. The second frame element 20 may form an upper boundary of the pocket 23 and may further form the boundary of two sides of the pocket 23. The second frame element 20 may directly form a part of the pocket 23, or the pocket 23 may have a separate casing. The pocket 23 is protected by the frame and can easily be accessed due do its position when the backpack is in the open state, as shown.

Figure 10:
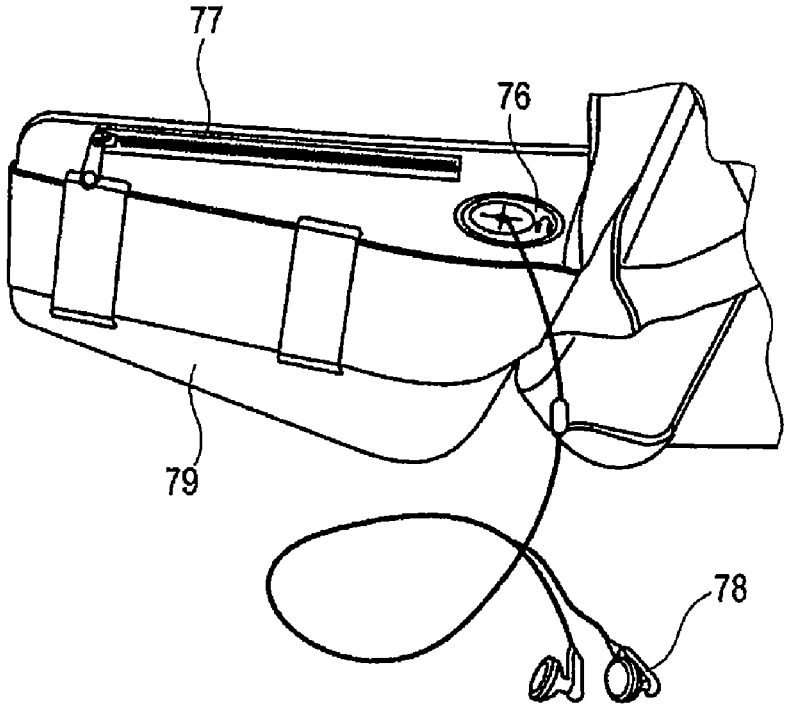
FIG. 10 is a perspective view of a portion of backpack, showing a waist strap that has an opening for earphones of a music player according to one embodiment of the present invention.

FIG. 10 shows another embodiment of a backpack in accordance with the present invention. As can be recognized, this backpack has a waist strap 79 with an opening 76 or tunnel for leading through cables of earphones 78, for example of a portable music device. Alternatively or in addition, the openings or the tunnel may be located in the cover or the frame of the backpack. Furthermore, the waist strap 79 may comprise a pocket 77 for storing a portable music device. The embodiment of a backpack shown in FIG. 10 may be independent of the further embodiments described in the present application.

Figure 11:
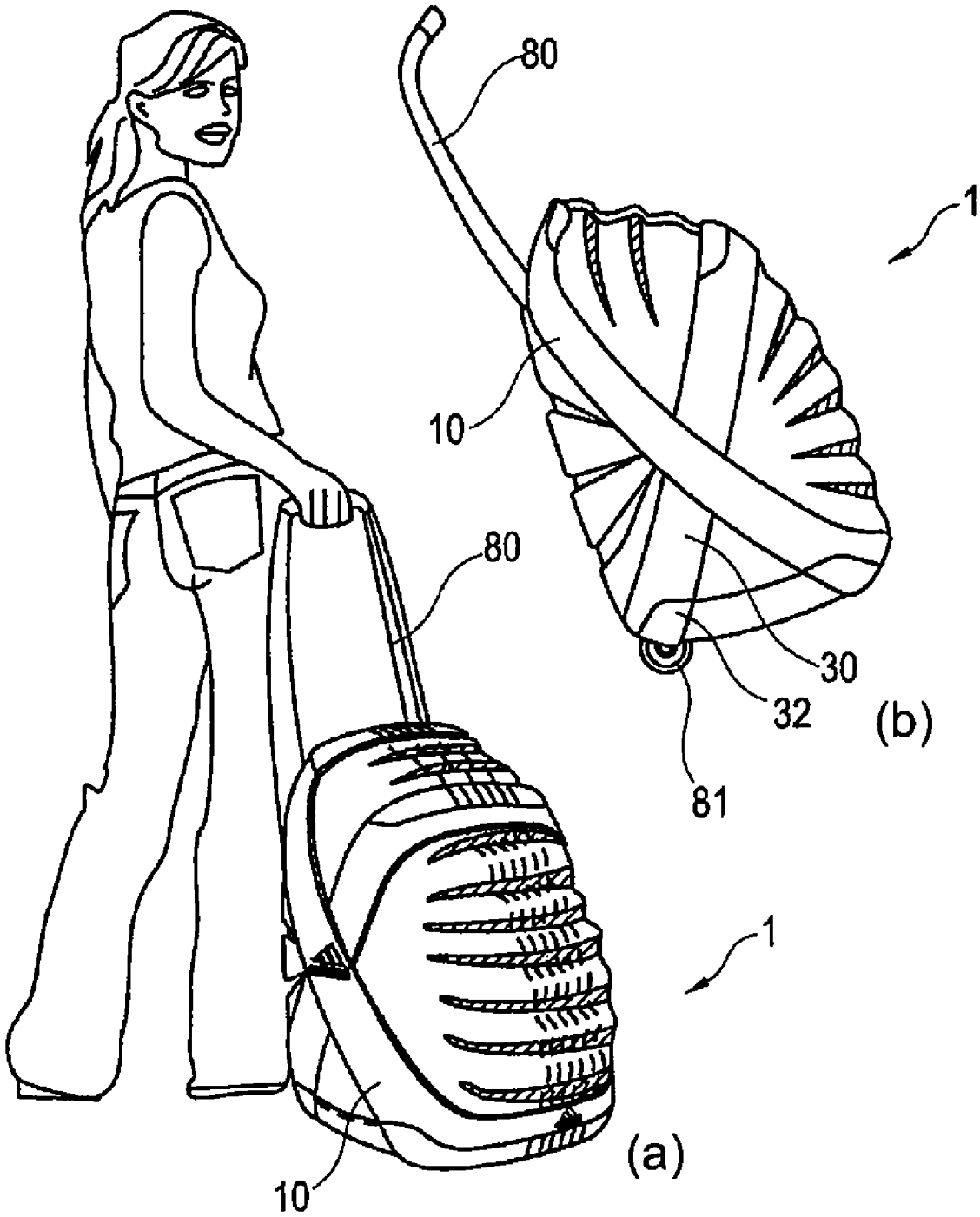
FIG. 11(*a*) is a perspective view of the backpack of FIG. 1 having wheels and an extendable handle, in accordance with one embodiment of the present invention.

Finally, FIG. 11(*a*) shows a perspective view and FIG. 11(*b*) shows a side view of the backpack 1 provided with an extendable handle 80 and wheels 81, in accordance with another embodiment of the present invention. The extendable handle 80 and wheels 81 enable the backpack 1 to be used as a trolley. The extendable handle 80 may be arranged on the first frame element 10. The wheels 81 may be arranged on the lower region of the third frame element 30.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. Thus, the present invention should not be limited by any of the above described exemplary embodiments, but should be defined only in accordance with the following claims and their equivalents.

What is claimed is:

1. A backpack, comprising:

a cover having a first portion and a second portion; and a frame, wherein the frame includes:

a first frame element attached to the first portion of the cover and having an upper region, a lower region, and side regions, wherein the side regions longitudinally extend from the upper region to the lower region, and wherein the lower region of the first frame element laterally extends between ends of the side regions;

a second frame element attached to the second portion of the cover, wherein the second frame element is pivotably connected to a portion of each of the side regions of the first frame element in a region between the upper region and the lower region of the first frame element; and a third frame element fixedly joined to the first frame element, wherein the first frame element, the second frame element and the third frame element together form the shape of an X in cross-sectional view, and wherein an opening in the cover is generated by a movement of the second frame element, and wherein the second portion of the cover is attached to the side regions of the first frame element below the region where the second frame element is pivotably connected and above where the lower region of the first frame element laterally extends.

2. The backpack according to claim 1, wherein a pocket extends adjacent to an upper region of the second frame element so that a part of the second frame element forms a boundary for the pocket.

3. The backpack according to claim 1, further comprising a rear portion directed towards the back of the wearer, wherein a waist strap extends from the rear portion, wherein the waist strap has an opening for receiving cables.

4. The backpack according to claim 1, further comprising a rear portion directed towards the back of the wearer, wherein the rear portion is adjusted to the form of a spine of a wearer.

5. The backpack according to claim 1, wherein the second frame element and the first frame element include a locking mechanism to lock movement of the second frame element relative to the first frame element in at least two positions.

6. The backpack according to claim 1, wherein the upper region of the first frame element and an upper region of the second frame element define a seat.

7. The backpack according to claim 1, wherein the cover includes a third portion extending between the upper region of the first frame element and an upper region of the second frame element, wherein a seat is provided by the third portion of the cover.

8. The backpack according to claim 1, wherein a portion of the cover is detached from the upper region of the first frame element so that a distance is established between the portion of the cover and the upper region of the first frame element.

9. The backpack according to claim 1, wherein one or more portions of the cover are concertina-folded.

10. The backpack according to claim 1, wherein the cover is arranged substantially on the inside of the frame.

11. The backpack according to claim 1, further comprising a closure mechanism releasably connecting the second frame element to the first portion of the cover.

12. The backpack according to claim 11, wherein the closure mechanism is at least one of a zip fastener, hook and loop fastener, and push buttons.

13. The backpack according to claim 1, wherein the third frame element has a lower region that defines a base for the backpack.

14. The backpack according to claim 13, wherein the second frame element and the third frame element are connected together at a common region of the first frame element.

15. The backpack according to claim 13, wherein the shape of the X in cross-sectional view is formed when the backpack is closed.

16. The backpack according to claim 13, wherein at least one of: side regions and the upper region of the first frame element, and the side regions and the lower region of the first frame element are substantially U-shaped.

17. The backpack according to claim 13, wherein at least one of the second frame element and the third frame element are substantially U-shaped in a front view.

18. The backpack according to claim 1, wherein the frame is integrally formed with a handle.

19. The backpack according to claim 18, wherein the handle is formed as a recess in the upper region of the first frame element.

20. A backpack, comprising:

a cover having a first portion and a second portion; and a frame, wherein the frame includes:

a first frame element attached to the first portion of the cover and having an upper region and a lower region;

a second frame element attached to the second portion of the cover, wherein the second frame element is pivotably connected to the first frame element in a region between the upper region and the lower region of the first frame element; and a third frame element connected to the first frame element, wherein the first frame element, the second frame element and the third frame element together form the shape of an X in cross-sectional view, and wherein the second frame element is pivotably arranged with respect to the third frame element, and wherein the third frame element has a lower region laterally extending between two side regions, wherein the side regions and the lower region of the third frame element together form a substantially U-shape in front view, wherein the lower region of the third frame element defines a base portion for the backpack, and wherein the upper region and the lower region of the first frame element are non-pivotally arranged with respect to each other, and wherein the first frame element forms one leg of the X and the second frame element and the third frame element together form the other leg of the X.

21. The backpack according to claim 20, wherein an opening in the cover is generated by a movement of the second frame element.

22. The backpack according to claim 20, wherein the lower region of the first frame element laterally extends between two side regions, wherein the side regions and the lower region of the first frame element together form a substantially U-shape in front view wherein the lower region of the first frame element defines another base portion for the backpack.

23. The backpack according to claim 20, wherein the cover is disposed along side regions and the lower region of the first frame element.

24. The backpack according to claim 23, wherein the second portion of the cover extends from the second frame element to the side regions and the lower region of the first frame element.

* * * * *

UNITED STATES PATENT AND TRADEMARK OFFICE

CERTIFICATE OF CORRECTION

PATENT NO. : 8,038,042 B2
APPLICATION NO. : 11/933961
DATED : October 18, 2011
INVENTOR(S) : Kaja Inga Anita Bartel It is certified that error appears in the above-identified patent and that said Letters Patent is hereby corrected as shown below:

On the first page, in section (30), the Foreign Application Priority Data reading "Nov. 2, 2006 (DE) 10 2006 051 765" should read --Nov. 2, 2006 (DE) 10 2006 051 765.2--.

Signed and Sealed this
Tenth Day of January, 2012

David J. Kappos

David J. Kappos
*Director of the United States Patent and Trademark Office*